US006525620B1

(12) United States Patent
Barabash

(10) Patent No.: US 6,525,620 B1
(45) Date of Patent: Feb. 25, 2003

(54) CAPACITIVE SIGNAL COUPLING DEVICE

(75) Inventor: Darrell W. Barabash, Grapevine, TX (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/316,457

(22) Filed: May 21, 1999

(51) Int. Cl.[7] ..... H01P 5/00

(52) U.S. Cl. ..... 333/24 C; 333/260; 343/702; 343/715; 343/850

(58) Field of Search ..... 333/24 C, 246, 333/260; 343/715, 702, 850

(56) References Cited

U.S. PATENT DOCUMENTS

| | | | | | |
|---|---|---|---|---|---|
| 4,821,041 | A | | 4/1989 | Evans | 343/700 |
| 4,894,663 | A | | 1/1990 | Urbish et al. | 343/702 |
| 5,073,761 | A | * | 12/1991 | Waterman et al. | 333/24 C |
| 5,093,670 | A | | 3/1992 | Braathen | 343/792.5 |
| 5,309,122 | A | * | 5/1994 | Cox et al. | 333/24 C |
| 5,410,749 | A | | 4/1995 | Siwiak et al. | 455/280 |
| 5,633,645 | A | | 5/1997 | Day | 343/700 |
| 5,694,135 | A | | 12/1997 | Dikun et al. | 343/700 |
| 5,706,019 | A | | 1/1998 | Darden, IV et al. | 343/895 |
| 5,717,160 | A | | 2/1998 | Bootle | 174/35 R |
| 5,757,246 | A | * | 5/1998 | Johnson | 333/24 C |
| 5,977,841 | A | * | 11/1999 | Lee et al. | 333/24 C |
| 6,053,777 | A | | 4/2000 | Boyle | 439/700 |
| 6,198,367 | B1 | * | 3/2001 | Matsunaga et al. | 333/260 X |

* cited by examiner

*Primary Examiner*—Benny Lee
(74) *Attorney, Agent, or Firm*—Blakely, Sokoloff, Taylor & Zafman LLP

(57) ABSTRACT

A capacitive signal coupling device to link an antenna radiating element to a peripheral device is disclosed. The capacitive signal coupling device includes a support and at least one conductive element on a first surface of the support. The conductive element is positioned to align with the radiating element of an antenna system and also includes a connector to enable a peripheral device to be connected to a transceiver antenna system without violating the integrity of the transceiver unit itself or without interrupting the operation of the transceiver system.

12 Claims, 5 Drawing Sheets

CAPACITIVE SIGNAL COUPLING DEVICE

FIELD OF THE INVENTION

The present invention pertains to signal coupling devices, including more particularly, to capacitive signal antenna coupling devices.

BACKGROUND OF THE INVENTION

Known wireless communications systems include a radio transceiver unit mounted on a roof or otherwise exterior to the building for which the wireless communication system is being used. The transceiver functions by transmitting and receiving information between a local network and a remote station such as a regional telephone service provider. These transceivers necessarily include an antenna to complete the wireless functionality of the system. A larger and more powerful antenna structure generally enables the transceiver to transmit and receive more efficiently and over a larger distance.

To reduce manufacturing costs, transceiver enclosures are often built without a connection that enables access to.either the operative elements of the antenna or to the internal circuitry of the transceiver unit. Since maintaining the environmental integrity of the system is extremely important, opening the transceiver enclosure or other after market modifications to the transceiver system may compromise the integrity of the unit, disrupt the proper functioning of the system or void any existing warranties.

Due to varying levels of signal and electromagnetic interference, shifting weather patterns, increased demand, or any other change in system requirements, the antenna systems normally incorporated into known transceiver systems may not always effectively communicate with a remote service provider.

Connecting a large antenna directly to the transceiver circuitry will increase the performance of the system. However, as previously described, if the transceiver system was not manufactured with a connection to facilitate this attachment, someone must mechanically and electronically modify the transceiver to accomplish the attachment. This task may involve cutting into the transceiver enclosure in order to access the antenna elements or transceiver electronics. This may result in the communication system being inoperative for a period of time and also exposes the transceiver to potential damage. Similarly such a modification may not be capable of being completed in the field, requiring the transceiver to be brought back to a technicians shop to service.

SUMMARY OF THE INVENTION

The capacitive signal coupling device of the present invention comprises, a support, at least one conductive element disposed on a first surface of the support, a grounding element disposed on a second surface of the support and a connector.

In another aspect, the present invention includes an antenna radiating element coupler comprising a support having first and second surfaces, at least one conductive element disposed on the first surface, a grounding element disposed on the second surface, and a connector formed into the support.

In a further aspect, the present invention also includes a method of coupling an external device to an antenna radiating element comprising forming a support with first and second surfaces, attaching a conductive element to the first surface, applying a grounding element to the second surface, and providing a connection to the conductive element and the grounding element.

DETAILED DESCRIPTION OF THE PREFERRED EMBODIMENTS

Figure 1:
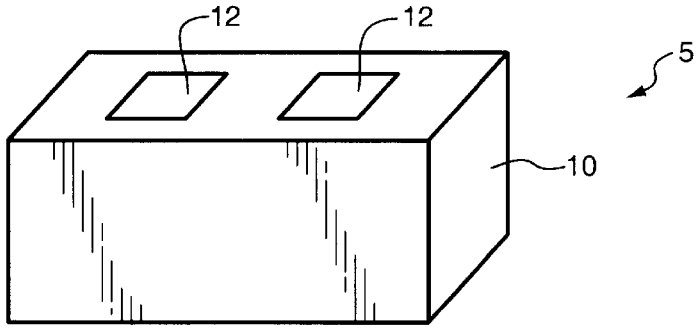
FIG. 1 is a transceiver system with a radiating element as would preferably be used in conjunction with the present invention

It should be noted that elements of similar structures or functions are labeled with the same reference numerals throughout the drawings, and are not described in detail for some of the drawings. Referring to the drawings, FIG. 1 shows a radio transceiver unit 5 as would preferably be used to communicate between a user and a service provider. The transceiver enclosure 10 houses the operative circuitry of the transceiver unit 5 and utilizes at least one radiating element 12. The radiating element 12 is the active component of a patch antenna, and is preferably located on the exterior surface of the transceiver enclosure 10. In an exemplary preferred embodiment, the transceiver enclosure 10 is a radiating enclosure. A preferred embodiment of such a radiating enclosure is disclosed in co-pending U.S. patent application Ser. No. 09/316,459 filed on May 21, 1999, the entirety of which is incorporated herein by reference.

In known applications, the transceiver unit 5 of FIG. 1 is mounted exteriorly, often on the roof or wall of a tall building, so that signals can be received without the potential interference caused by electromagnetic energy and to avoid the signal attenuation caused by an adjacent building structure. If there is unwanted interference with the broadcasting and receiving functions of the transceiver unit 5, unwanted path attenuation or if the transceiver unit 5 is subsequently required to broadcast over a larger range then it was originally designed for, it becomes desirable to boost the signal strength and reception sensitivity of the transceiver unit 5. One method of accomplishing this is to operatively connect the existing transceiver unit 5 to a larger peripheral antenna. Such a peripheral antenna can take the form of a remote tower antenna, a larger stand alone antenna mounted in relative proximity to the transceiver unit 5 or a telescoping antenna. In order to link this peripheral antenna to the antenna of the transceiver unit 10, the peripheral antenna needs to be operatively coupled to the radiating elements 12 of the transceiver antenna.

Figure 2:
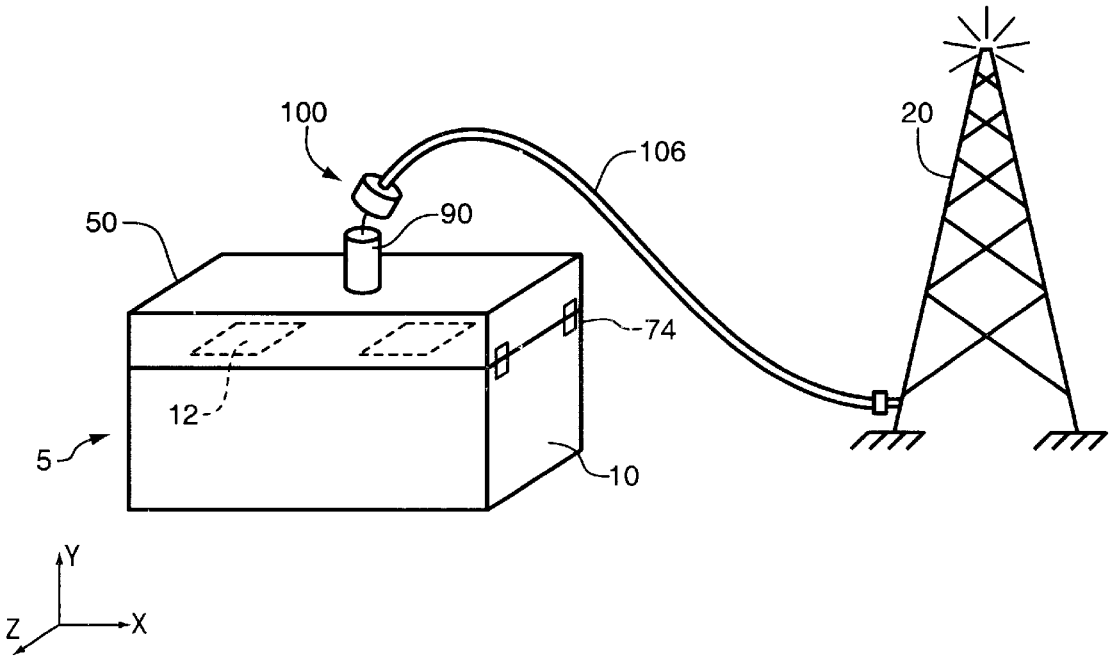
FIG. 2 is the capacitive signal coupling device of the present invention engaged with the transceiver system of FIG. 1.

Referring now to FIG. 2, the capacitive signal coupling device 50 of the present invention is shown as it would link the radiating elements 12 of the transceiver unit 5 to a peripheral antenna 20. The antenna 20 desirably has a larger gain than the antenna normally incorporated into the transceiver unit 5 or it can be mounted in a better location than the actual transceiver unit, thereby accommodating additional network requirements. Likewise, the antenna 20 is positioned so as to avoid obstructions which may interfere with transmission and reception.

Without disturbing the environmental integrity of the transceiver unit 5 and without interrupting the service provided by the transceiver to the local network, the capacitive signal coupler 50 provides a capacitive connection between the radiating elements 12 on the transceiver enclosure 10 and the antenna 20. The capacitive signal coupler 50 includes a connector 90 formed into the exterior surface of the coupler support. The connector 90 is formatted as a male connector and allows a female connector 100, attached to the end of a cable 106, to mate with the connector 90 and ultimately connect to the antenna 20. In a preferred embodiment, the capacitive signal coupler 50 also includes fasteners 74. The fasteners 74 engage with the transceiver enclosure 10 and maintain the transceiver enclosure 10 and the capacitive signal coupler 50 in operative alignment in the x, y and z axis. The capacitive signal coupler 50 can be quickly and easily installed on an existing transceiver enclosure without the need to expose the internal circuitry of the transceiver unit and without the need to interrupt communication services to and from the local network. The capacitive signal coupling device 50 of the present invention is preferably designed in such a way to enable one with little or no knowledge of antenna or transceiver maintenance and construction to install and remove the capacitive signal coupler 50. Additionally, the manufacturing costs associated with the transceiver unit 5 are minimized, since a connector does not need to be unilaterally incorporated into the transceiver enclosure 10. A capacitive signal coupler 50 can be later purchased only for those transceiver units requiring them.

Figure 3:
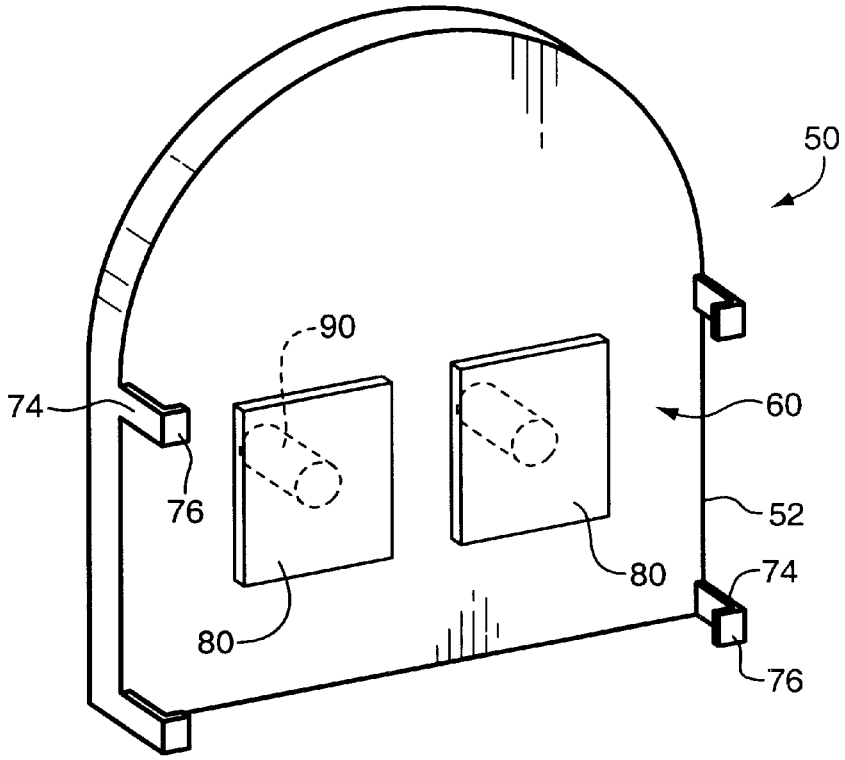
FIG. 3 is a perspective view of a coupling device embodying the present invention.
Figure 4:
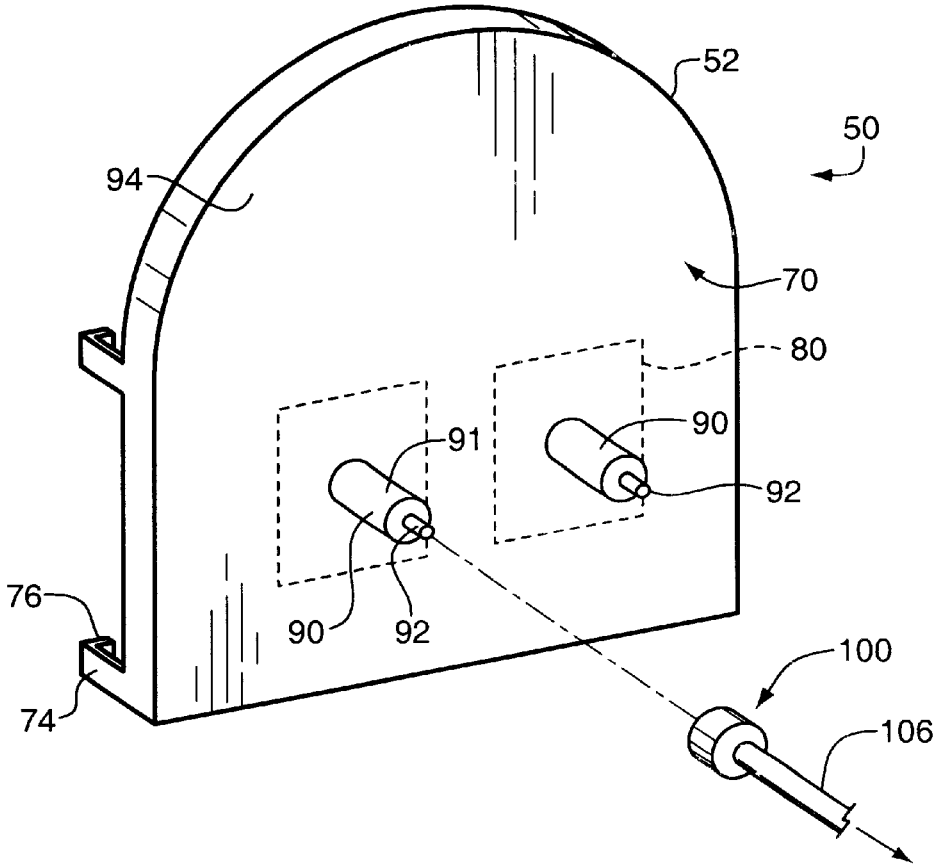
FIG. 4 is another perspective view of a coupling device embodying the present invention.

Referring now to FIGS. 3 and 4, the inside surface 60 (FIG. 3) is the surface of the capacitive signal coupler 50 that eventually faces the transceiver enclosure 10 (FIG. 2) it engages with. The general shape of the capacitive signal coupler 50 can vary and will preferably conform to the shape of the top surface of the corresponding transceiver enclosure 10 for which it is designed. It is contemplated that the capacitive signal coupler 50 can be manufactured for use with several standard sized transceiver enclosures. Custom made couplers can also be manufactured. The capacitive signal coupler 50 includes a support structure 52 with a first surface 60 and a second surface 70 (FIG. 4). The first surface 60 has attached or integrated into it at least one conductive element 80. The support 52 is preferably formed from a non-conductive thermoplastic material which will not interfere with the operation of the antenna or transceiver systems. The material from which the support 52 is formed should be dielectric and have appropriate radio frequency characteristics for the application it is being used. The support material is also preferably one that is conducive to an injection molding process in order to facilitate an easy and inexpensive manufacturing process. The conductive elements 80 are preferably made from a thin sheet of copper, but can be made from most other electrically conductive materials. Ideally, the conductive elements 80 are formed from a similar material to that of the active radiating elements 12 on the transceiver enclosure 10 as shown in FIGS. 1, 2. The conductive elements 80 are also of a similar shape to the active radiating elements 12 so that when in operative alignment, coupling losses and resonances can be minimized. The preferred transceiver system 5, depicted in FIGS. 1 and 2, has the radiating elements 12 integrated into the transceive enclosure 10. The enclosure body itself forms the dielectric component in the antenna unit. The capacitive signal coupler 50 of the present invention utilizes a similar concept by extending the gain of the radiating elements 12, through a capacitive link, to a larger antenna. By using a capacitive link, actual contact of the radiating elements 12 and the conductive elements 80 is not necessary.

Included as a part of the support 52 are fasteners 74. The fasteners 74 are located on the periphery of the support 52 and protrude away from and essentially normal to the first surface 60. The fasteners 74 are biased toward the center of the capacitive signal coupler 50 and have on their distal end, a clip portion 76. When attached to a transceiver, the clip portions 76 engage with corresponding slots 78 (Depicted in FIG. 5) on the transceiver enclosure 10 and function to reversibly secure the capacitive signal coupler 50 to the transceiver enclosure 10 while also maintaining the two components in operative alignment in the x, y and z coordinates. The fasteners 74 are easily disengaged from the slots 78 in order to remove the capacitive signal coupler 50 from the transceiver enclosure 10. Since in order to maintain a consistent capacitive connection, the conductive elements 80 and the radiating elements 12 must be kept in a fixed position relative to each other, the fasteners 74, along with the corresponding slots 78 also aid in assuring that a proper alignment between these elements is maintained.

Alternately, an alignment pin and spacer could be utilized to further ensure an accurate and consistent x, y and z coordinate position.

Focusing specifically on FIG. 4, the support 52 of the capacitive signal coupler 50, includes on its second surface 70 a connector 90 (also shown in FIG. 3). The second surface 70 is the surface that will be left exposed when the capacitive signal coupler 50 is engaged with a transceiver enclosure. The second surface 70 of the capacitive signal coupling device 50 and the surface 91 of the connector 90 are covered with a metalized grounding element 94. The combination of the conductive elements 80, the grounding element 94 and the dielectric properties of the support 52, form a patch antenna system similar to that present in a preferred embodiment of the radiating enclosure 10. By locating the conductive elements 80 in close proximity to and aligned with the radiating elements 12, a capacitive link is formed between the radiating elements 12 on the radiating enclosure 10 and the conductive elements 80 on the support 52. In a preferred embodiment, the connector 90 includes a conductor pin 92 extending through the central axis of the connector, contacting the conductive elements 80. A simultaneous connection can therefore be made to the grounding element 94 and the conductive elements 80. The connector 90 is preferably formatted so that a low cost screw type radio frequency connector, such as UHF, SMA or TNC connector can be utilized to make this connection.

To make the external connection to the capacitive signal coupler 50, a cable 106, preferably includes a threaded connector 100. The connector 100 is formed so that it can be easily handled by a user, making attachment and removal simple. The cable 106 extends from the connector 100 and is of such a length to allow it to extend from the radiating enclosure 10 to a similarly formatted connector located on a peripheral device.

Figure 5:
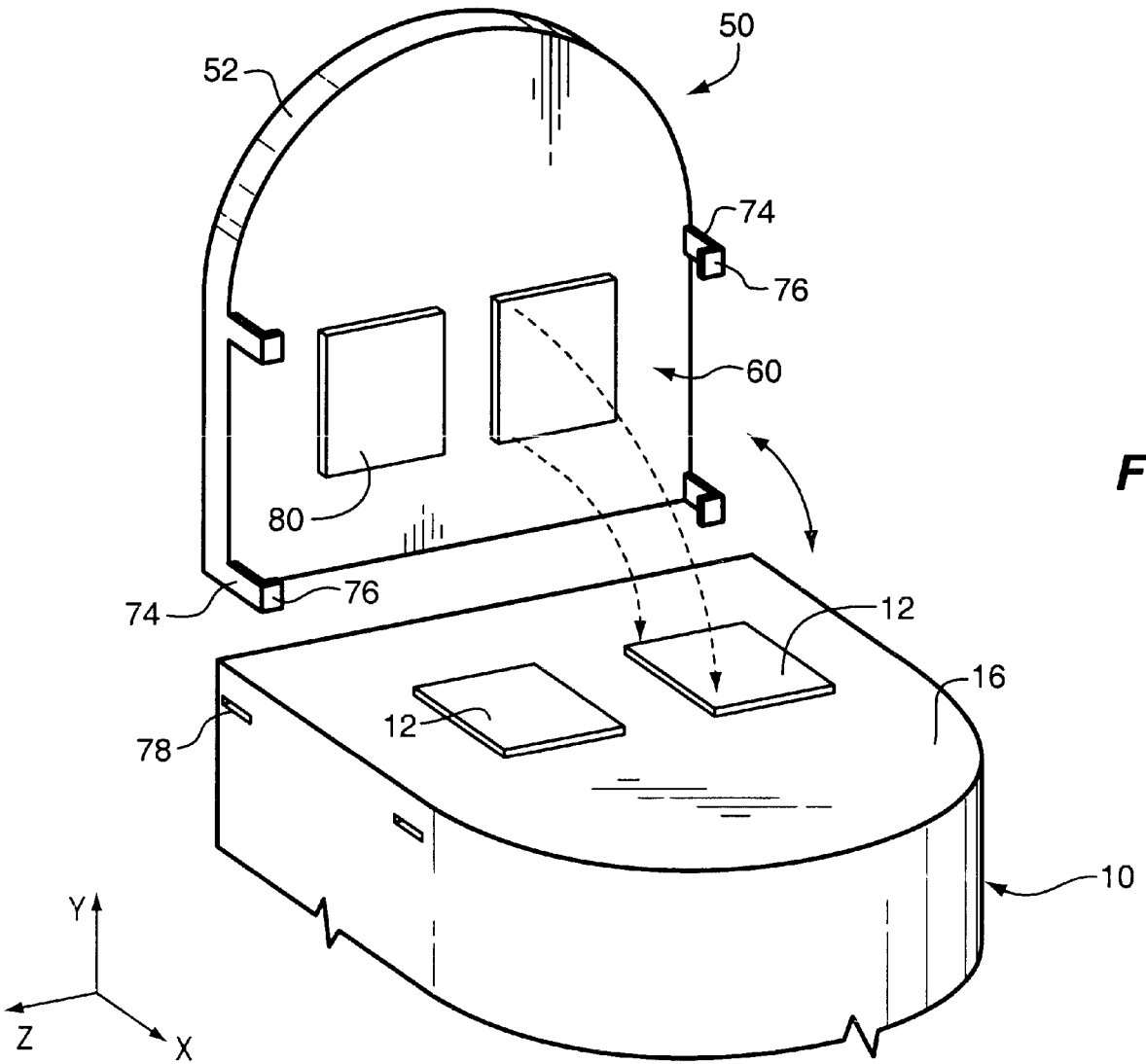
FIG. 5 is a perspective view of the capacitive signal coupling device of the present invention shown in relation to a corresponding transceiver system.

Referring now to FIG. 5, the capacitive signal coupler 50 of the present invention is shown as it would align and operatively connect to a radiating enclosure 10. The dashed lines indicate how the active radiating elements 12 of a radiating enclosure would align with the capacitive elements 80 of the capacitive signal coupler 50. The shape of the capacitive signal coupler 50 is such that it conforms essentially to the shape of the radiating enclosure 10 and when attached will give the appearance of structural uniformity. The conductive elements 80 are positioned on the first surface 60 of the capacitive signal coupler 50 so that when the coupler is attached to the radiating enclosure 10, as depicted in FIG. 5, the conductive elements 80 will accurately align in the x, y, and z coordinates, with the active radiating elements 12 positioned on the second surface 16 of the radiating enclosure.

Figure 6A:
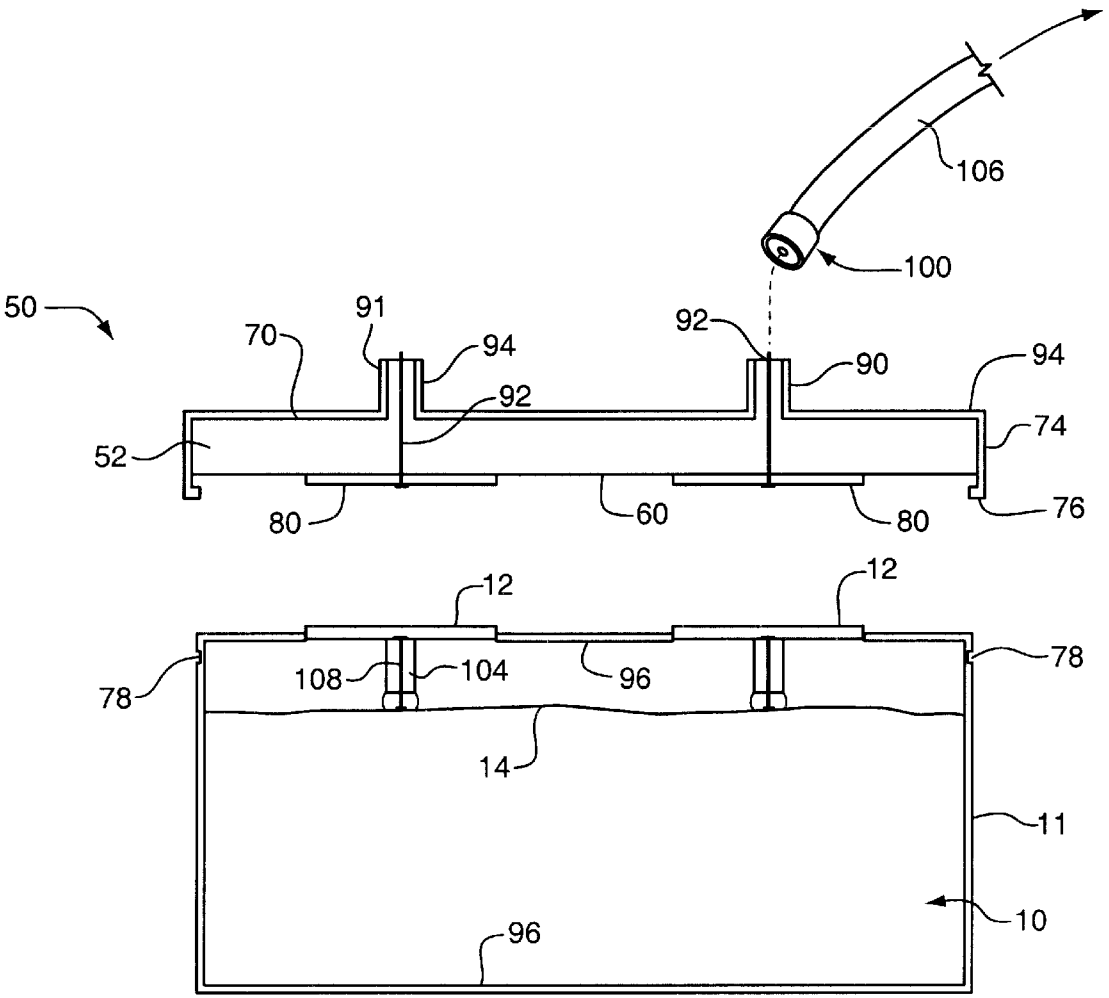
FIG. 6A is a cross sectional view of the capacitive signal coupling device of the present invention in relation to a corresponding transceiver unit.
Figure 6B:
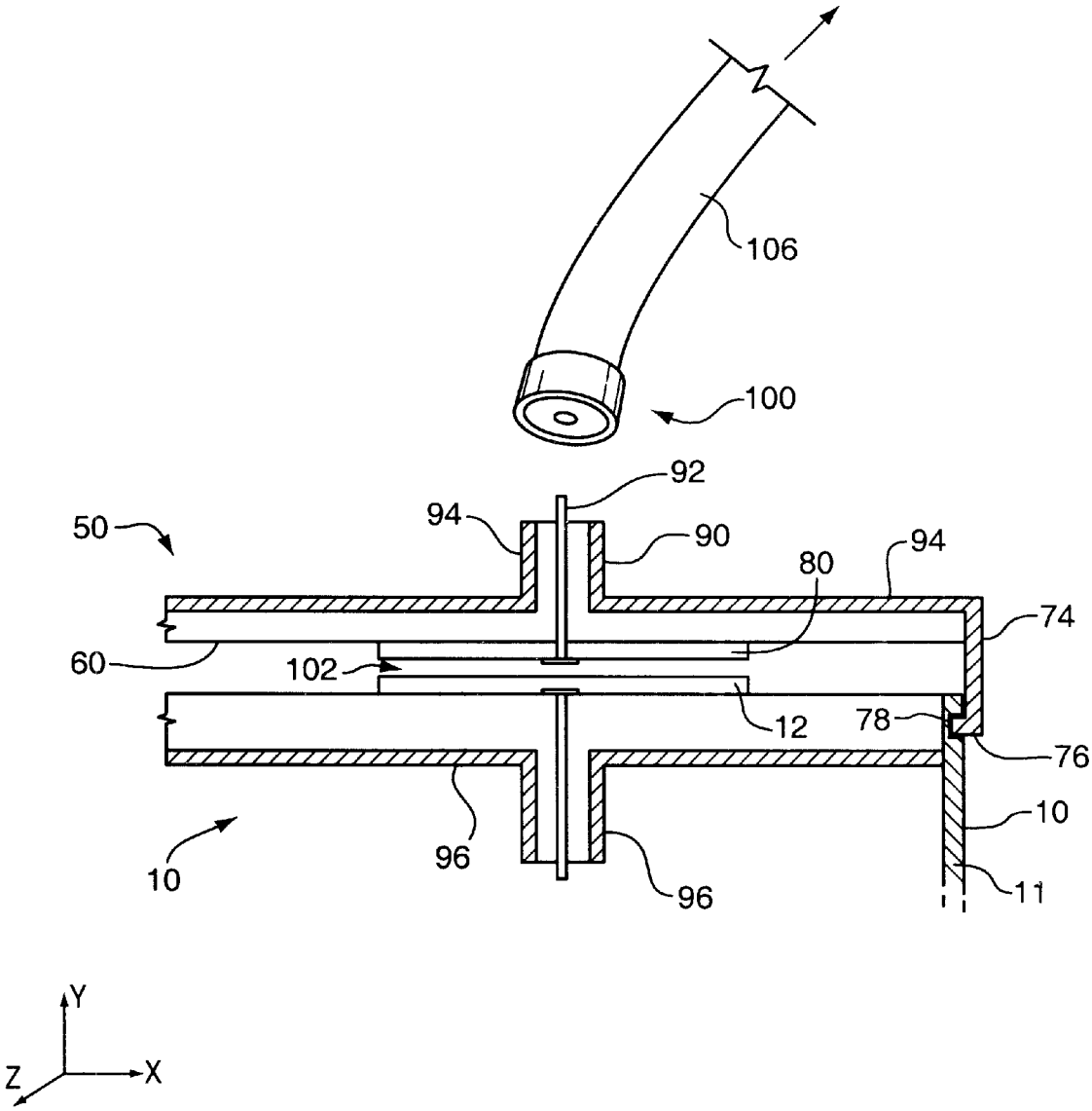
FIG. 6B is a partial cross-sectional view of the capacitive signal coupling device of the present invention while engaged with a corresponding transceiver unit.

Referring now to FIGS. 6A and 6B, a cross section is shown of the capacitive signal coupler 50 of the present invention. The radiating enclosure 10 is shown with an integrated patch antenna system. The patch antenna is formed from three main components: 1) a dielectric body 11, 2) a groundplane material 96 distributed on the interior surface of the body 11, and 3) an active radiating element 12 on the exterior surface of the transceiver enclosure 10. The connection between the radiating enclosure and the transceiver circuitry is made through a connector, partially comprising a boss 104 and conductor pin 108 as best shown in FIG. 6A. Further details of this type of patch antenna are set out in copending U.S. patent application Ser. No. 9/316,459, filed on May 21, 1999, which has already been incorporated herein by reference in its entirety. Briefly, as best shown in FIG. 6A the conductor pin 108 extends through the cover portion of the transceiver body 11 and contacts the radiating element 12. In conjunction with the groundplane material 96 distributed on the interior surface of the body 11, and the surface 104 of the boss, this arrangement provides a coaxial connection from the patch antenna to the internal transceiver circuitry 14.

The capacitive signal coupler 50 of the present invention provides a simultaneous and preferably coaxial connection to the radiating element and internal circuitry of the transceiver unit 5. An external coaxial connector 90 is provided so that a peripheral device can be coupled to the transceiver circuitry. The capacitive signal coupling device 50 as shown in FIG. 6A includes a support 52 formed from a dielectric material. The support 52 includes at least one connector 90 formed into its exterior surface and preferably in the form of an essentially normally protruding boss. Extending through the central axis of the connector 90, an elongate conductor 92 contacts a conductive element 80 located on the interior surface 60 of the coupler body 5 52. A grounding element 94 is preferably distributed on the exterior surface 70 of the support and also on the surface 91 of the connector 90.

The connector 90, the conducting element 80, the dielectric body 52 and the grounding element 94, form an antenna and by it capacitively coupling to the transceiver antenna, allow an external or otherwise peripheral device to be connected to the capacitive signal coupler 50 and, as will be discussed in conjunction with FIG. 6B, to the antenna and transceiver circuitry.

A cable 106 with an end mounted connector 100 is designed to mate with the connector 90 integrated into the support 52. Alternately, instead of providing a connection device such as the coaxial arrangement previously described, a cable can be molded into the support 52, forming an integral component of the 20 capacitive signal coupler 50.

FIG. 6B, shows a closer view of a portion of the capacitive signal coupler 50 as it engages with a radiating enclosure.

Specifically, it can be seen in FIG. 6B that when the capacitive signal coupler 50 is positioned on the radiating enclosure 10, the radiating element 12 of the radiating enclosure 10, aligns with the conductive element 80 on the capacitive signal coupler 50. A capacitive coupling is achieved by maintaining a consistent air gap 102 between the radiating element 12 and the conductive element 80. The fasteners 74 and clips 76 secure the capacitive signal coupling device 50 in a proper x, y and z alignment, thereby maintaining a proper vertical gap 102 as well as the proper horizontal alignment. Since the connection is capacitive, even if there is a protective coating, sticker or paint over the radiating element 12, the capacitive coupling can still be achieved.

Although the invention has been described and illustrated in the above description and drawings, it is understood that this description is by example only and that different embodiments may be made without departing from the true spirit and scope of the invention. The invention therefore should not be restricted, except within the spirit and scope of the following claims.

What is claimed is:

1. A method, of coupling an external device to an antenna radiating element comprising:

forming a support-with first and second surfaces;

attaching a conductive element to said first surface;

applying a grounding element to said second surface;

providing a connection to said conductive element and said grounding element;

attaching said support to a transceiver system, said transceiver system having a radiating enclosure;

providing recessed notches in the radiating enclosure;

providing fasteners on the periphery of said support; and engaging respective said fasteners within corresponding said recessed notches.

2. The method as set forth in claim 1, wherein engaging said fasteners within said recessed notches maintains said conductive element and said antenna radiating element in operative alignment.

3. The method as set forth in claim 2 wherein engaging said fasteners within said recessed notches maintains a consistent air gap between said conductive element and said antenna radiating element.

4. An antenna radiating element coupler comprising:

a support having first and second surfaces;

said support removably attachable to an enclosure;

at least one conductive element disposed on said first surface, the at least one conductive element being operatively aligned with an antenna radiating element;

a grounding element disposed on said second surface;

a connector attached to said second surface of said support; and an enclosure.

5. The device as set forth in claim 4, wherein said antenna radiating element is an active element in a radiating enclosure.

6. The device as set forth in claim 4, wherein said antenna radiating element is an active element in a patch antenna system.

7. A method of coupling an external device to an antenna radiating element that is an active element in a radiating enclosure, the method comprising:

forming a support with first and second surfaces;

removably attaching said support to an enclosure;

attaching a conductive element to said first surface;

applying a grounding element to said second surface; and providing a connection to said conductive element and said grounding element.

8. A method of coupling an external device to an antenna radiating element comprising:

forming a support with first and second surfaces;

removably attaching said support to an enclosure;

attaching a conductive element to said first surface;

applying a grounding element to said second surface;

providing a connection to said conductive element and said grounding element;

operatively aligning said conductive element with said antenna radiating element; and forming a capacitive connection between said conductive element and said antenna radiating element.

9. A method of coupling an external device to an antenna radiating element that is an active element of a patch antenna system, the method comprising:

forming a support with first and second surfaces;

removably attaching said support to an enclosure;

attaching a conductive element to said first surface;

applying a grounding element to said second surface; and providing a connection to said conductive element and said grounding element.

10. An antenna radiating element coupler comprising:

a support having first and second surfaces;

said support removably attachable to an enclosure;

at least one conductive element disposed on said first surface, the at least one conductive element having a capacitive connection with an antenna radiating element;

a grounding element disposed on said second surface;

a connector attached to said second surface of said support; and an enclosure.

11. An antenna radiating element coupler comprising:

a support having first and second surfaces;

said support removably attachable to an enclosure;

at least one conductive element disposed on said first surface;

a grounding element disposed on said second surface;

a connector attached to said second surface of said support;

an enclosure; and a fastener to maintain a consistent air gap between said at least one conductive element and an antenna radiating element.

12. The device as set forth in claim 11, wherein said fastener further maintains said at least one conductive element and said radiating element in alignment.

* * * * *

UNITED STATES PATENT AND TRADEMARK OFFICE

CERTIFICATE OF CORRECTION

PATENT NO. : 6,525,620 B1
DATED : February 25, 2003
INVENTOR(S) : Barabash

It is certified that error appears in the above-identified patent and that said Letters Patent is hereby corrected as shown below:

Column 5,
Line 48, delete “5 52”, insert -- 52 --.

Signed and Sealed this

Tenth Day of June, 2003

JAMES E. ROGAN
*Director of the United States Patent and Trademark Office*